US009913542B2

(12) United States Patent
Chiasson

(10) Patent No.: US 9,913,542 B2
(45) Date of Patent: Mar. 13, 2018

(54) CHAIR WITH A TENSION-COMPRESSION STRUCTURE

(71) Applicant: David Chiasson, Edmonton (CA)

(72) Inventor: David Chiasson, Edmonton (CA)

( * ) Notice: Subject to any disclaimer, the term of this patent is extended or adjusted under 35 U.S.C. 154(b) by 151 days.

(21) Appl. No.: 14/993,309

(22) Filed: Jan. 12, 2016

(65) Prior Publication Data

US 2016/0213154 A1 Jul. 28, 2016

Related U.S. Application Data

(60) Provisional application No. 62/106,567, filed on Jan. 22, 2015.

(51) Int. Cl.

| | |
|---|---|
| ***A47C 9/10*** | (2006.01) |
| ***A45B 5/00*** | (2006.01) |
| *E04B 1/19* | (2006.01) |

(52) U.S. Cl.

CPC ..... *A47C 9/105* (2013.01); *A45B 5/00* (2013.01); *A47C 9/10* (2013.01); *E04B 2001/1996* (2013.01)

(58) Field of Classification Search

CPC ... E04B 2001/1996; A45B 5/00; A47C 4/286; A47C 9/00; A47C 9/10; A47C 9/105; Y10T 403/45

See application file for complete search history.

(56) References Cited

U.S. PATENT DOCUMENTS 382,308 A * 5/1888 Kamerer ..... A45B 5/00 248/155.4

393,160 A * 11/1888 Lange ..... A45B 5/00 248/155.5

(Continued)

FOREIGN PATENT DOCUMENTS

| | | |
|---|---|---|
| CN | 202009878 | 10/2011 |
| DE | 20201383 | 9/2002 |

(Continued)

OTHER PUBLICATIONS

Tensegrity Stool, https://www.behance.net/gallery/12453419/Tensegrity-Stool, available as early as Aug. 20, 2015 [19 pages].

(Continued)

*Primary Examiner* — Ryan D Kwiecinski

(74) *Attorney, Agent, or Firm* — Davis & Bujold PLLC; Michael J. Bujold

(57) ABSTRACT

There is provided a seating device having a group of three or more rigid compression members with successively smaller outer diameters that are sized to form a single nested structure. The seating device further has a seat having three or more seat connection points spaced about a flexible supporting web, a base having three or more base connection points, the three or more base connection points being connected by base tension members, and three or more flexible side tension members. Each compression member is removably engaged between a combination of a selected seat connection point and a selected base connection point, and each side tension member is engaged between a combination of a selected seat connection point and a selected base connection point, the combination of connection points engaged by each side tension member being different than the combination of connection points engaged by each compression member.

20 Claims, 14 Drawing Sheets

(56) References Cited

U.S. PATENT DOCUMENTS 413,962 A * 10/1889 Putnam ..... A47C 9/105 248/155.5
591,549 A * 10/1897 Behrens ..... A47C 4/286 135/66
617,661 A * 1/1899 Smith ..... A45B 5/00 297/118
883,674 A * 3/1908 Sherwood ..... A45B 5/00 248/155.4
1,282,105 A * 10/1918 Mowry ..... A45B 5/00 248/155.2
2,798,536 A * 7/1957 Shew ..... A45B 5/00 108/115
3,169,611 A * 2/1965 Snelson ..... E04B 1/19 256/37
3,310,340 A 3/1967 Brewer et al.
3,544,051 A * 12/1970 Norman ..... A45B 5/00 248/155
4,148,520 A * 4/1979 Miller ..... A47C 4/286 297/16.2
4,354,437 A 10/1982 Logan
5,851,052 A * 12/1998 Gustafsson ..... A47C 4/286 248/164
5,876,091 A * 3/1999 Chernomashentsev ..... A47C 4/286 224/155
6,634,704 B1 * 10/2003 Bergquist ..... A47C 9/105 108/118
6,868,640 B2 * 3/2005 Barber ..... A47B 13/02 108/150
6,899,388 B1 * 5/2005 Enrique ..... A47C 7/66 297/129
8,602,044 B2 12/2013 Zemitis
8,833,000 B1 9/2014 Nadeau
2002/0002807 A1 * 1/2002 Newland ..... E04B 1/19 52/645
2003/0009974 A1 1/2003 Liapi
2004/0140696 A1 * 7/2004 Grace ..... A47C 9/105 297/16.2
2007/0216212 A1 * 9/2007 Micheel ..... A47C 9/105 297/451.2
2007/0257540 A1 * 11/2007 Park ..... A47C 4/286 297/451.2
2013/0187431 A1 * 7/2013 Grace ..... A47C 4/00 297/452.48
2014/0034097 A1 2/2014 Pao
2014/0034098 A1 * 2/2014 Pao ..... A45B 5/00 135/66
2015/0000213 A1 * 1/2015 Nadeau ..... E04B 1/34 52/63
2015/0351548 A1 * 12/2015 Schiraga ..... A47C 4/04 297/452.1
2017/0099955 A1 * 4/2017 Aydt ..... A47C 4/286

FOREIGN PATENT DOCUMENTS

FR 415958 A * 10/1910 ..... A45B 5/00
FR 634660 A * 2/1928 ..... A45B 5/00
JP 2008075397 4/2008

OTHER PUBLICATIONS

Tension Lounge Chair, https://www.1stdibs.com/furniture/seating/lounge-chairs/tension-lounge-chair-jh-varichon/id-f_759762/, available as early as Aug. 20, 2015 [2 pages].
Tensegrity—Furniture, https://tensegrity.wikispaces.com/Furniture, available as early as Aug. 20, 2015 [18 pages].
Paragron Chair, http://campaignfurniture.com/print/80218, Campaign Furniture, similar product available on website as early as Dec. 12, 2014, chair circa 1918. [3 pages].

* cited by examiner

CHAIR WITH A TENSION-COMPRESSION STRUCTURE

TECHNICAL FIELD

This relates to a portable seating device with a tension—compression structure that can be easily assembled, disassembled, stored, and transported.

BACKGROUND

Within the older demographic, there is a desire for portable chairs or stools. This desire can also be found in those attending festivals, on vacation, hiking, etc. However, this desire becomes necessity for those with limited mobility. People that can still walk but are limited in the distance they can walk need to have access to sitting arrangements when they become fatigued. Sitting on the floor or ground is not an option given their limited agility. These situations can occur within airports, shopping centers, or within any indoor/outdoor public area. Since public seating in some areas or situations is limited (such as standing in an airport ticket queue when flights are cancelled), there is a need for these people to carry portable seating. Current commercially available offerings are limited in seating area and portability. Some of these current offerings include walkers, cane stools, and campaign furniture. An example of this portable seating is found in U.S. Pat. No. 3,310,340.

SUMMARY

According to an aspect, there is provided a seating device comprising a group of three or more rigid compression members having successively smaller outer diameters, wherein each rigid compression member that has a larger outer diameter relative to at least one other rigid compression member is hollow and has an inner diameter sized to receive the outer diameter of the at least one other rigid compression member such that the rigid compression members are sized to form a nested structure, a seat having three or more seat connection points spaced about a flexible supporting web, a base having three or more base connection points, the three or more base connection points being connected by flexible base tension members, each rigid compression member being removably engaged between a combination of a selected seat connection point and a selected base connection point, and three or more flexible side tension members, each flexible side tension member being engaged between a combination of a selected seat connection point and a selected base connection point, the combination of connection points engaged by each flexible side tension member being different than the combination of connection points engaged by each rigid compression member.

According to another aspect the seating device may comprise three rigid compression members or four rigid compression members.

According to another aspect, one or more flexible side tension members may be releasable to release tension in the flexible side tension members.

According to another aspect, the one or more flexible side tension members may comprises a ratchet or a latch.

According to another aspect, the seating device may further comprise end caps engaging each of the first and second ends of the plurality of rigid compression members, each end cap further engaging the seating portion or the base portion.

According to another aspect, the end caps may comprise attachment points for attaching to at least one of the plurality of flexible side tension members.

According to another aspect, the end caps may comprise an interior diameter that is substantially the same as the exterior diameter of the respective rigid compression member.

According to another aspect, each of the end caps may comprise a visible indicator of the rigid compression member having the corresponding exterior diameter According to another aspect, in the nested structure, the rigid compression members may comprise a handle at a first end and a closure that maintains the rigid compression members in the nested structure.

According to another aspect, the nested structure may comprise a walking stick or a cane.

According to another aspect, the rigid compression members may form two nested structures comprising a pair of hiking poles.

According to another aspect, the base may comprise a base web and the flexible base tension members may be components of the base web.

According to another aspect, the seating device may comprise spring members connected between the flexible base tension members and the flexible supporting web of the seat.

According to another aspect, the seating device may comprise sleeves containing the rigid compression members, the sleeves extending at least a portion of the distance between the base and the seat.

According to another aspect, each of the sleeves may comprise a visible indicator of the corresponding rigid compression member.

According to another aspect, at least one end of each of the rigid compression members has an end profile that is curved or faceted.

According to an aspect, there is provided a method of assembling a chair, the method comprising providing a base having three or more base connection points, the three or more base connection points being connected by flexible base tension members, and a seat having three or more seat connection points spaced about a flexible supporting web, attaching a plurality of flexible side tension members between a combination of a selected base connection point and a selected seat connection point, inserting a group of three or more rigid compression members into the base connection points, the group of three or more rigid compression members having successively smaller outer diameters, wherein each rigid compression member that has a larger outer diameter relative to at least one other rigid compression member is hollow and has an inner diameter sized to receive the outer diameter of the at least one other rigid compression member such that the rigid compression members are sized to form a nested structure, angling each of the rigid compression members to extend above at least a portion of the base, and inserting each of the rigid compression members into the seat connection points such that each rigid compression member is removably engaged between a combination of a selected seat connection point and a selected base connection point, the combination of connection points engaged by each flexible side tension member being different than the combination of connection points engaged by each rigid compression member.

According to another aspect, the group of three or more rigid compression members may comprise three rigid compression members or four rigid compression members.

According to another aspect, the method may further comprise the step of increasing tension on at least one of the flexible side tension members using a ratchet or a latch.

According to another aspect, the base may comprise a base web and the flexible base tension members may be components of the base web.

According to another aspect, each of the rigid compression members may further comprise end caps engaging each of the first and second ends of the plurality of rigid compression members, each end cap further engaging the seating portion or the base portion.

According to another aspect, the end caps may comprise attachment points for attaching to at least one of the plurality of flexible side tension members.

According to another aspect, the end caps may comprise an interior diameter that is substantially the same as the exterior diameter of the respective rigid compression member.

According to another aspect, the end caps may comprise a visible indicator of the rigid compression member having the corresponding exterior diameter.

According to another aspect, the method may further comprise the steps of disassembling the chair comprising disengaging each of the first and second ends of the plurality of rigid compression members from the end caps, removing each of the rigid compression members from the seat connection points and the base connection points and inserting rigid compression members having smaller outer diameters into rigid compression members having larger outer diameters to form the nested structure.

According to another aspect, the method may further comprise the step of releasing tension in one or more flexible side tension members prior to removing the rigid compression members.

According to another aspect, the method may further comprise releasing tension in one or more flexible side tension members using a ratchet or a latch.

According to another aspect, in the nested structure, the rigid compression members may comprise a handle at a first end and a closure that maintains the rigid compression members in the nested structure.

According to another aspect, the nested structure may comprise a walking stick or a cane.

According to another aspect, the rigid compression members may be formed into two nested structures comprising a pair of hiking poles.

According to another aspect, the method may farther comprise the steps of collapsing the chair by releasing tension in one or more flexible side tension members and collapsing the rigid compression members together.

According to another aspect, the method may further comprise the step of providing spring members connected between the flexible base tension members and the flexible supporting web of the seat.

According to another aspect, the spring members may cause the seat and the base to draw together when the rigid compression members are collapsed together.

According to another aspect, angling each of the rigid compression members may comprise inserting each of the rigid compression members through a sleeve, the sleeve extending at least a portion of the distance between the base and the seat.

According to another aspect, each of the sleeves may comprise a visible indicator of the corresponding rigid compression member.

According to another aspect, at least one end of each of the rigid compression members has an end profile that is curved or faceted.

In other aspects, the features described above may be combined together in any reasonable combination as will be recognized by those skilled in the art.

BRIEF DESCRIPTION OF DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
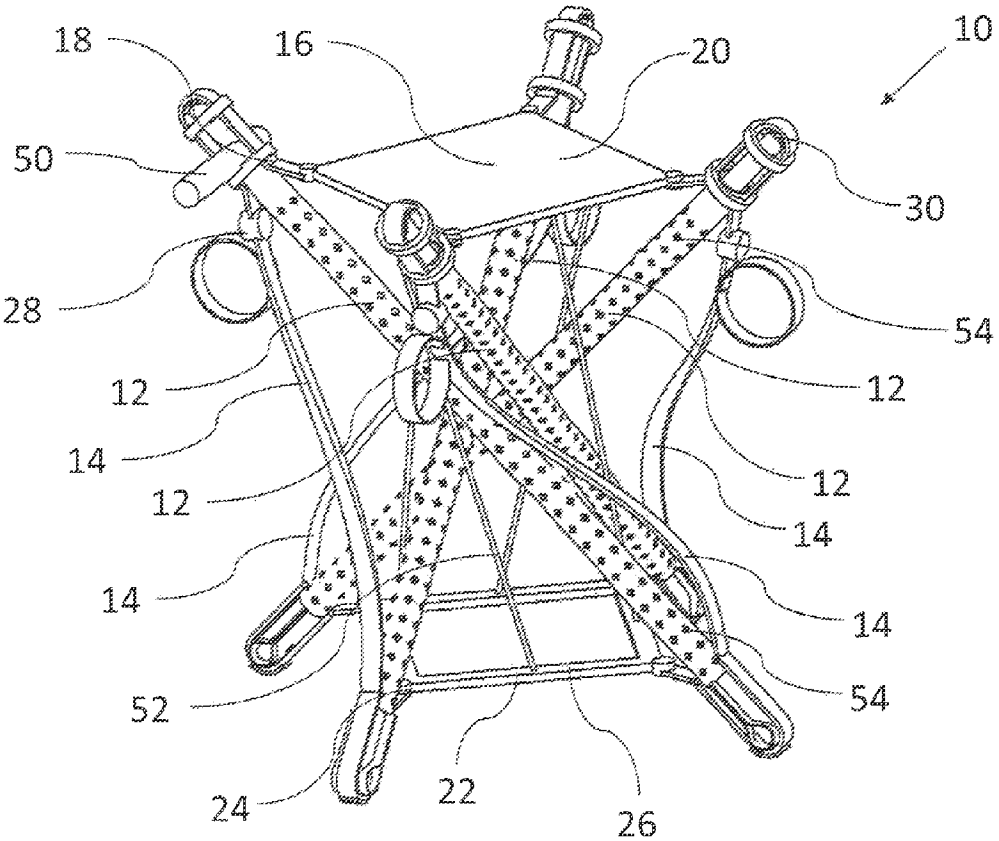
FIG. 1 is a perspective view of a seating device.

A seating device generally identified by reference numeral 10, will now be described with reference to FIG. 1 through 14.

Referring to FIG. 1, seating device 10 is formed using groups of compression members 12 and tension members 14 to form a tensegrity structure. Tensegrity structures rely on isolated components under compression within a net of continuous tension, such that the compression components do not contact each other and the tension components delineate the structure spatially. Ideally, components are either under pure compression or pure tension, and no bending moments are experienced by any structural members. However, some bending of real compression members is expected depending on material and load. In the ideal form of this structure, the tensile members are attached to the outermost ends of the compression members, and no attachment device is required in the centre of the structure. The use of tension and compression members may results in a structure that requires less material, has less weight, and is consequently more portable than a similar structure, capable of supporting a similar load, formed solely of compression members. The simplest of these structures is comprised of three compression members and nine tension members. Tensegrity structures have been used in architecture and furniture design. An example of a tensegrity structure is found in U.S. Pat. No. 3,169,611. A preferred embodiment of a tensegrity structure is described below.

Figure 9B:
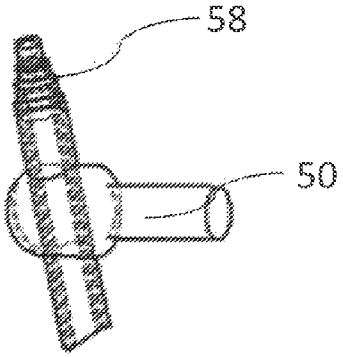
FIG. 9*b* is a detail side view of the portion of the cane shown in region G of FIG. 9*a*.
Figure 9C:
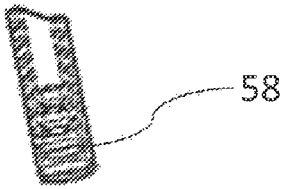
FIG. 9*c* is a detail side view of the portion of the cane shown in region H of FIG. 9*a*.
Figure 9A:
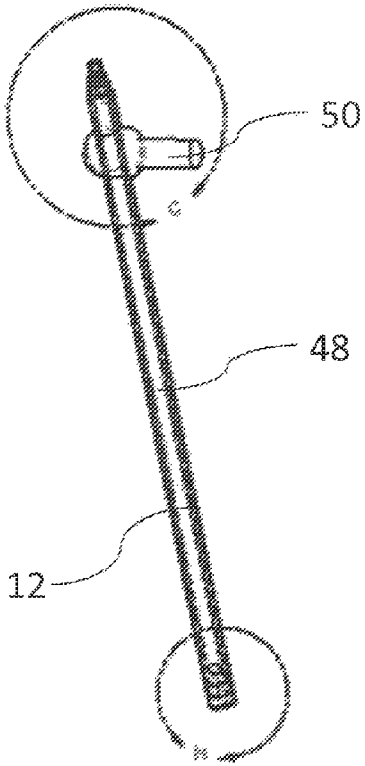
FIG. 9*a* is a side view of a cane formed by nested compression members.

In the depicted embodiment, the structure has a group of three or more rigid compression members 12. For example, in FIG. 1, seating device 10 is shown with four rigid compression members 12. Alternatively, in FIG. 10, seating device 10 is shown with three rigid compression members 12. More compression members 12 may also be used, however the complexity of the structure increases with each additional member. Compression members 12 may be formed from a variety of materials, as will be understood by one skilled in the art. For example, compression members 12 may be formed from thin walled, high strength metal alloys, composite materials, polymers, organic materials, etc. All of the rigid compression members 12 in the group have successively smaller outer diameters and are sized to form a nested structure, as shown in FIG. 9*a* through 9*c*. In order for rigid compression members 12 to nest, all of the compression members 12, with the exception of the smallest compression member 12, are hollow. As the smallest compression member 12 will not receive any other compression members 12, it is not required to be hollow, although it may be hollow to reduce the weight and amount of material required in manufacturing. The size and thickness of compression members 12 will depend on the required strength. Providing compression members 12 with successively smaller outer diameters that can form a nested structure allows smaller compression members 12 to be lit within larger compression members 12. At least one rigid compression member 12 has a larger inner diameter relative to the outer diameter of at least one other rigid compression member 12 to receive at least one other rigid compression member 12.

Figure 2:
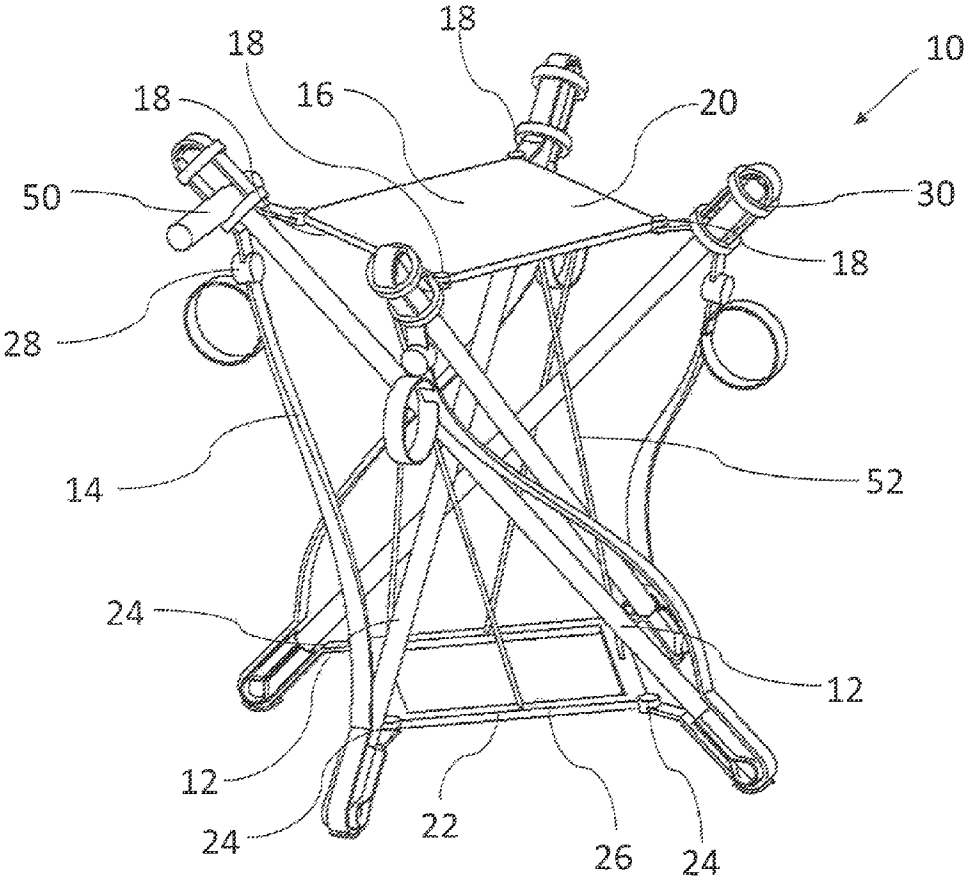
FIG. 2 is a perspective view of the seating device shown in FIG. 1 with the fabric sleeves removed.
Figure 10:
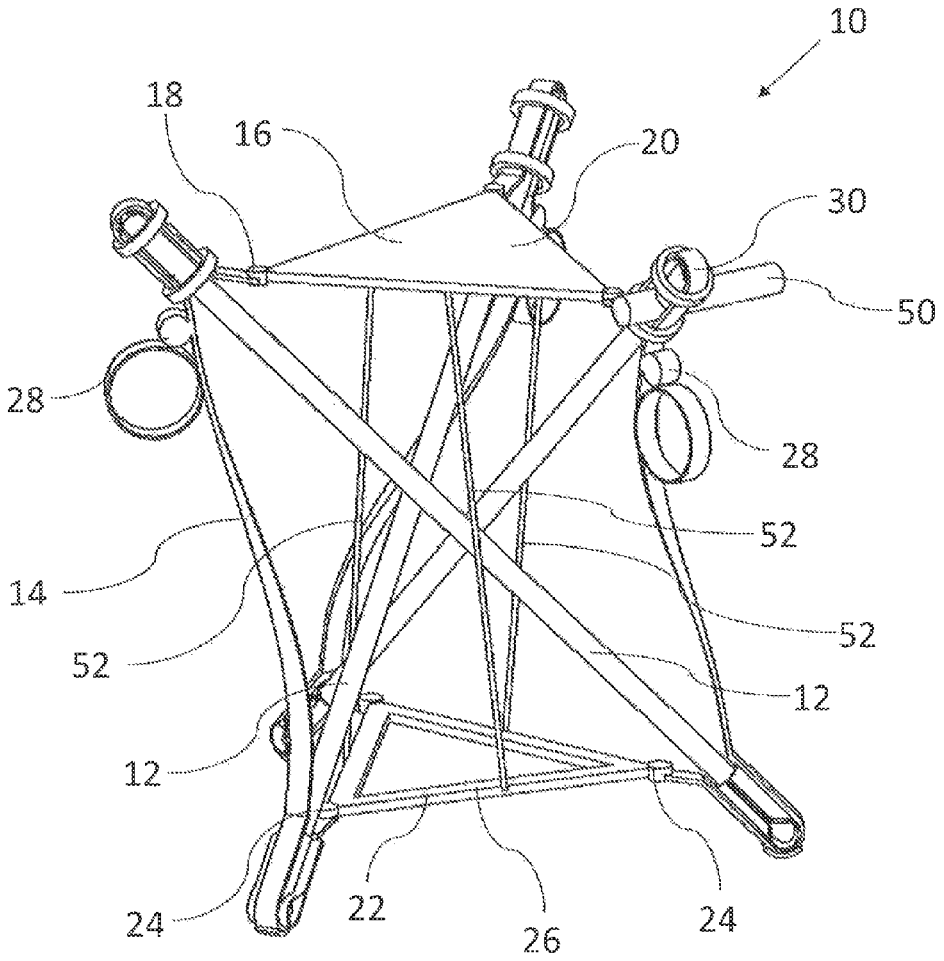
FIG. 10 is a perspective view of a fully assembled seating device having three compression members.
Figure 12:
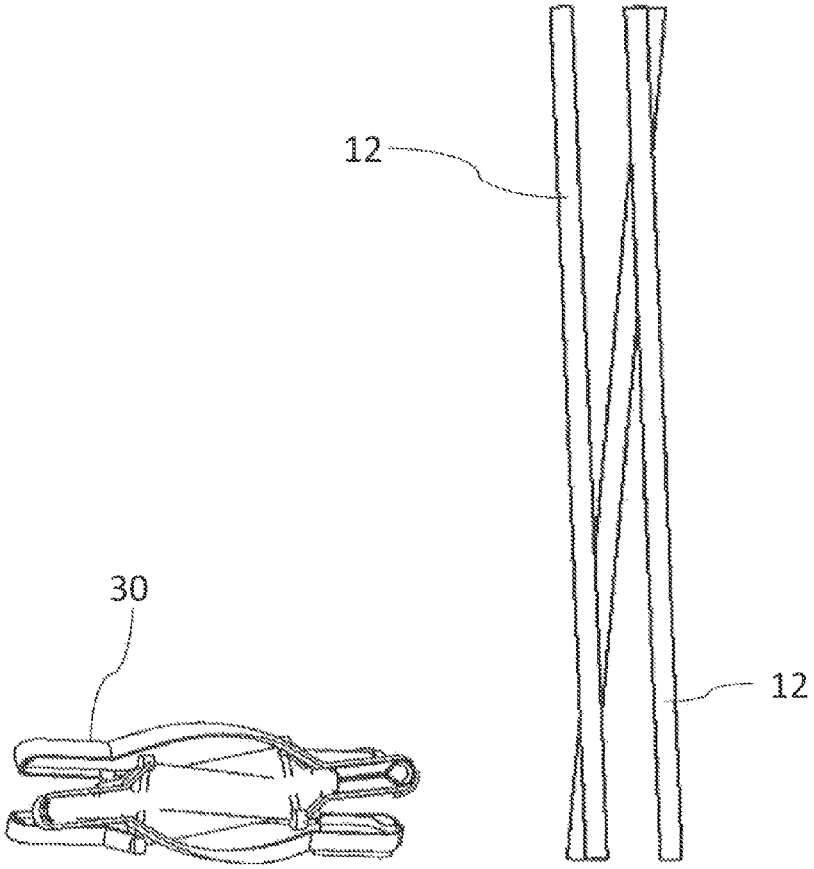
FIG. 12 is a perspective view of a fully disassembled seating device as shown in FIG. 10.
Figure 13A:
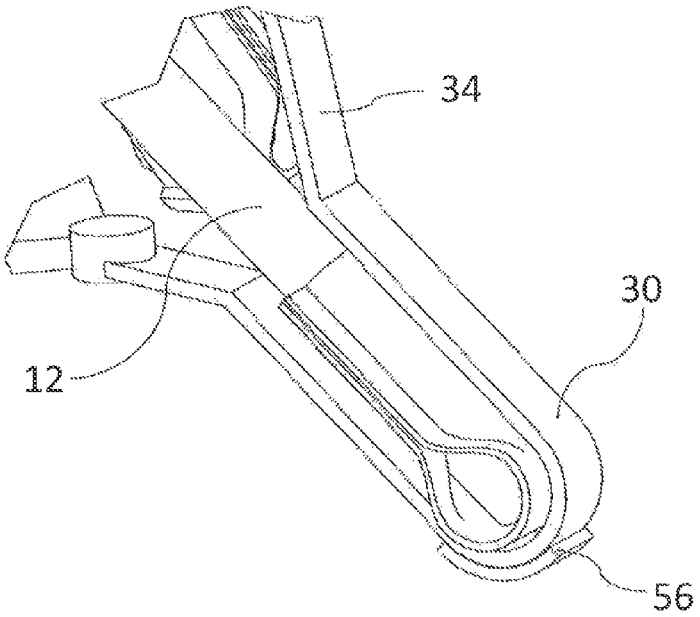
FIG. 13*a* is a detail view of an alternate embodiment of a lower end cap for a compression member.
Figure 13B:
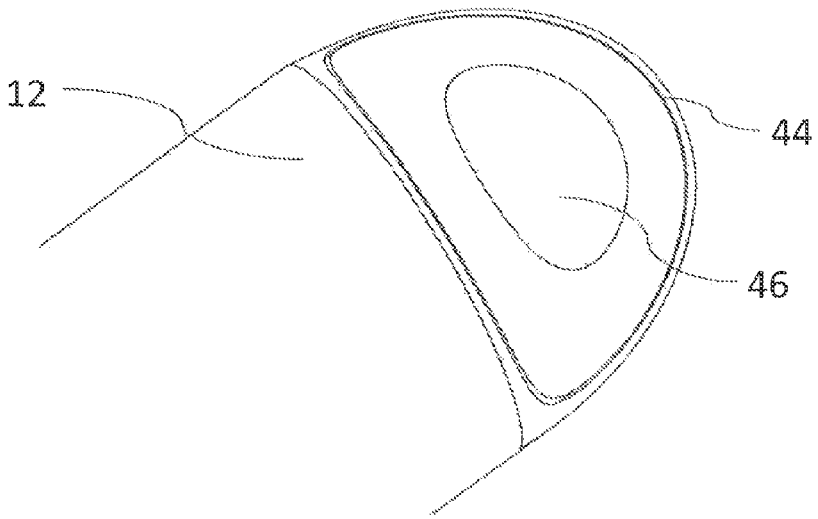
FIG. 13*b* is a perspective view of the contour on the end of the alternate embodiment of a lower end cap as shown in FIG. 13*a*.

Referring to FIG. 1, compression members 12 may be placed within sleeves 54, which are attached to a seat 16 to be supported. Sleeves 54 may, for example, be made from an elastic material and may be used to guide compression members 12 when seating device 10 is being assembled. Sleeves 54 may be colour coded along with compression members 12 to aid in assembly, allowing for compression members 12 of different diameters to be placed in the correct location. Referring to FIG. 2, seating device 10 has a seat 16 having three or more seat connection points 18 spaced about a flexible supporting web 20. Seating device 10 also has a base 22 having three or more base connection points 24, the three or more base connection points 24 being connected by flexible base tension members 26. Base 22 may also have a base web (not shown), similar to seat web 20, and flexible base tension members 26 may be components of the base web, or may be distinct from the base web. Referring to FIG. 10 and FIG. 12, each rigid compression member 12 is removably engaged between a combination of a selected seat connection point 18 and a selected base connection point 24.

Referring to FIG. 2, seating device 10 further has three or more flexible side tension members 14. Flexible side tension members 14 cooperate with rigid compression members 12 to create the tensegrity structure of chair 10. Tension members 14 may be constructed from high strength materials such as nylon, polypropylene, Keylar™, hemp, ultra-high-molecular-weight polyethylene, other polymers, organic filaments, steel cables, other fabrics, etc. Each flexible side tension member 14 is engaged between a combination of a selected seat connection point 18 and a selected base connection point 24. To create the structure of chair 10, the combination of connection points 18 and 24 engaged by each flexible side tension member 14 is different than the combination of connection points 16 and 24 engaged by each rigid compression member 12. For example, as shown in FIG. 10, flexible side tension members 14 engage a combination of seat and base connection points 18 and 24 that are approximately vertically aligned, while rigid compression members 12 extend diagonally to engage seat connection points 18 that are one position further around chair 10 than the base connection points 24. A second example is shown in FIG. 2, where flexible side tension members 14 extend diagonally to engage seat connection points 18 that are one position further around chair 10 than the base connection points 24, and rigid compression members 12 extend diagonally to engage seat connection points 18 that are two positions further around chair 10 than the base connection points 24, and one position further around chair 10 than the end of tension members 14 emanating from the same base connection points 24. Referring to FIG. 10, in order to release tension in flexible side tension members 14, for example when chair 10 is to be disassembled, one or more of the flexible side tension members 14 may releasable using any method known in the art, such as by using a latch or a ratchet 28 as shown, to release tension in flexible side tension members 14. When a latch or ratchet 28 is used, slack may be provided in flexible side tension members 14, such that seating device 10 can be partially collapsed into the structure shown in FIG. 11 and continuity of tension members 14 is maintained to aid in reassembly of seating device 10. When assembled, latch or ratchet 28 is tightened to ensure that sufficient tension is applied to structure 10 that it maintains its integrity when subjected to external loads.

Figure 3B:
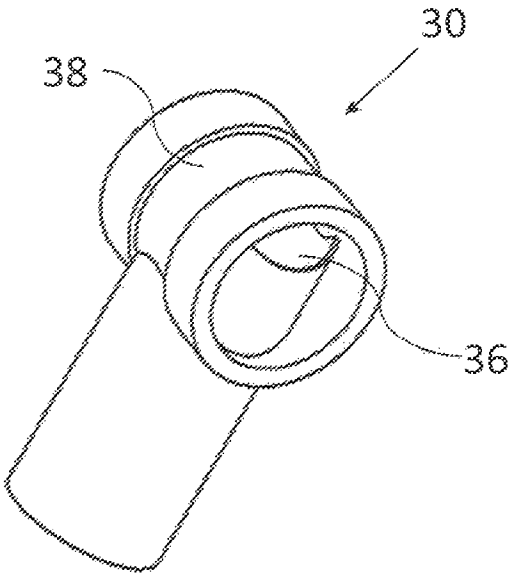
FIGS. 3*a* and 3*b* are perspective views of end caps for a compression member.
Figure 3A:
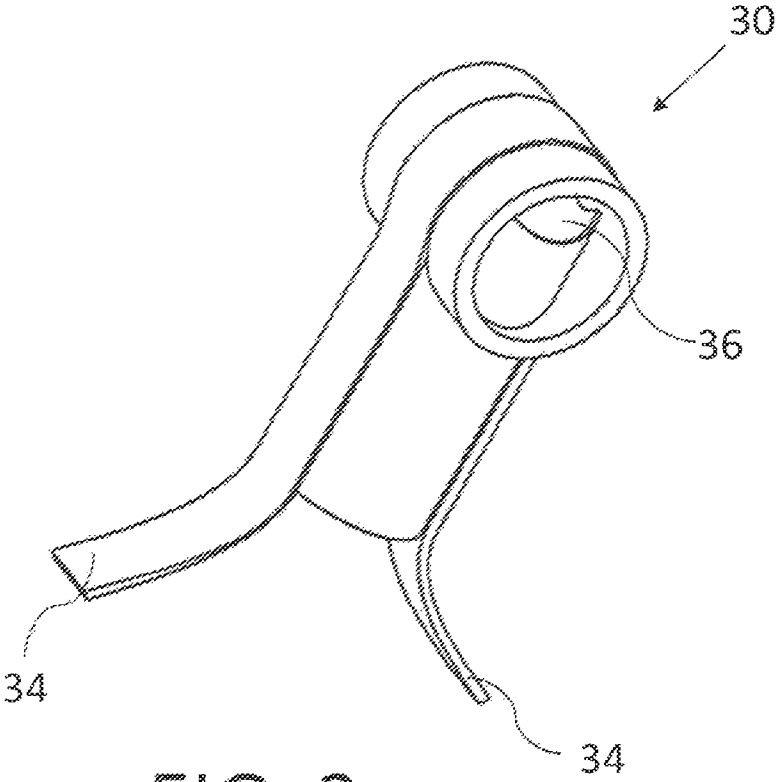
Figure 4:
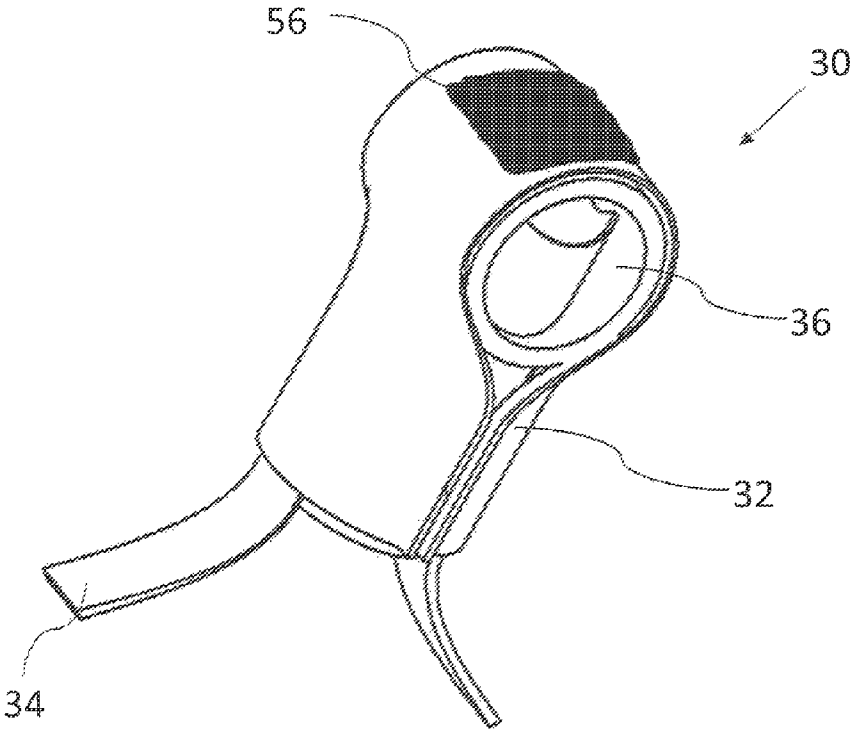
FIG. 4 is a perspective view of the end cap shown in FIG. 3*a* having a fabric cover.
Figure 5B:
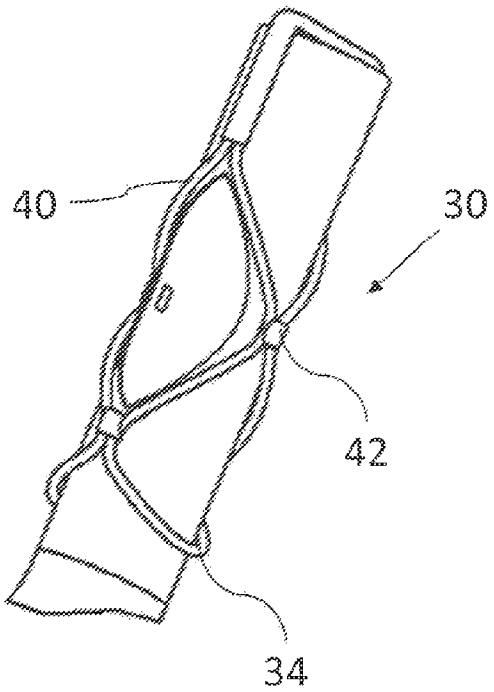
FIG. 5*b* is a detail perspective view of the portion of the alternate end cap shown in region B of FIG. 5*a*.
Figure 5A:
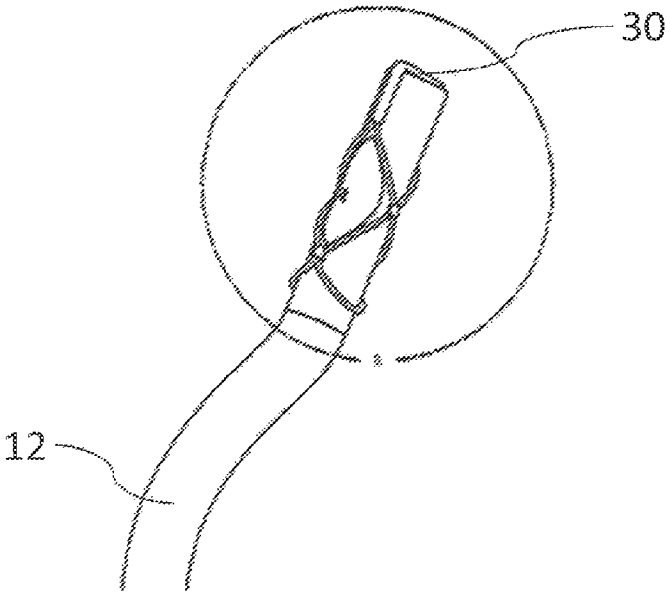
FIG. 5*a* is a perspective view of an alternate end cap for a compression member.
Figure 6B:
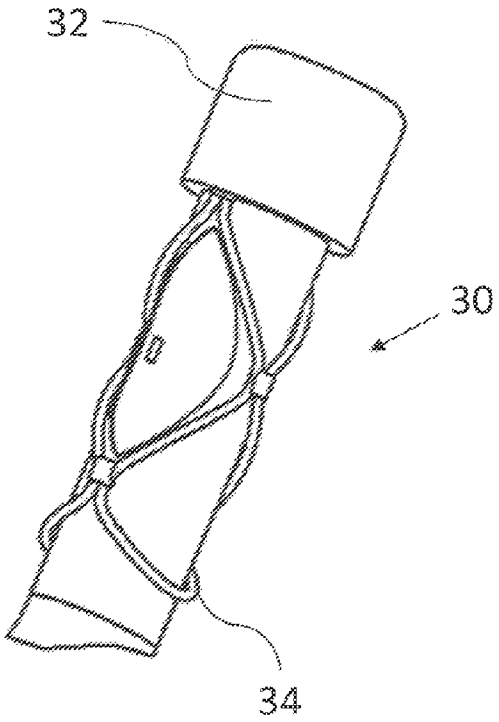
FIG. 6*b* is a detail perspective view of the portion of the end cap shown in region B of FIG. 6*a*.
Figure 6A:
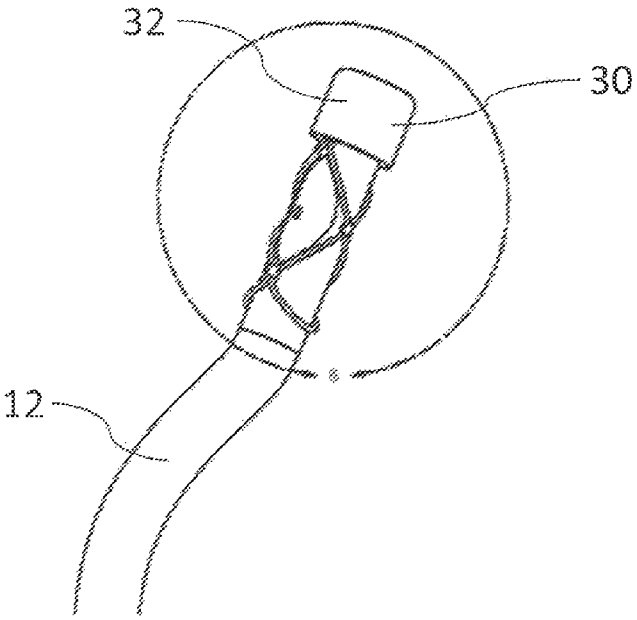
FIG. 6*a* is a perspective view of the end cap shown in FIG. 5*a* having a cover.
Figure 7:
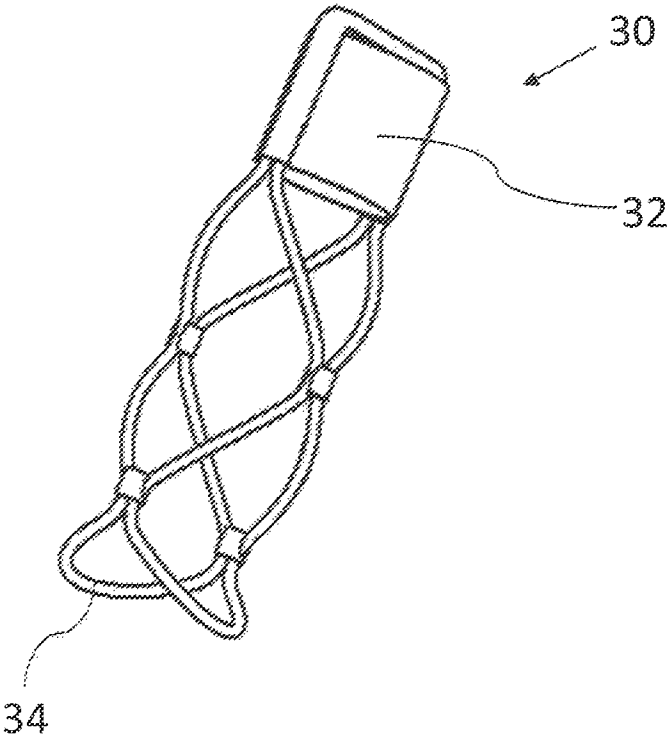
FIGS. 7, 8*a*, and 8*b* are perspective views of alternate covers for the end cap shown in FIG. 5*a*.
Figure 8B:
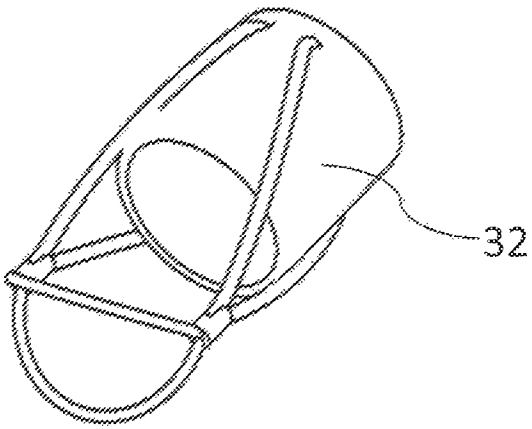
Figure 8A:
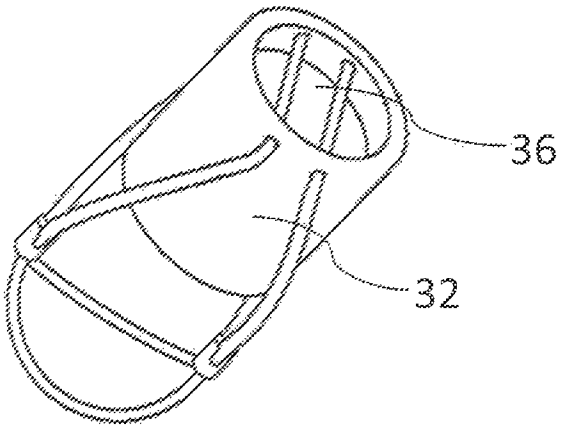

Referring to FIG. 3 through FIG. 8 and FIG. 13 and FIG. 14, seating device 10 may be provided with end caps 30 applied to each of the first and second ends of rigid compression members 12. These end caps 30 may take various forms, as will be understood by those skilled in the art. Examples of three versions of end caps 30 are seen in FIG. 3, FIG. 5, and FIG. 8. End caps 30 may also differ between the upper end of compression member 12, as shown in FIG. 14*a*, and the lower end of compression member 12, as shown in FIG. 13*a*. These end caps may further have protective covers 32, especially when end caps 30 will engage the ground surface. Examples of these covers are seen in FIG. 4, FIG. 6, and FIG. 7. End caps 30 engage at least one of seating portion 16 and base portion 22. For example, end caps 30 may be provided on only the lower or base portion ends of rigid compression members 12 to provide added traction, or may be provided only on the upper or seat portion ends of rigid compression members 12 to provide protection against sharp corners on rigid compression members 12. A shown in FIG. 3 and FIG. 5, end caps 30 may also have attachment points 34 for attaching to at least one of the flexible side tension members 14. These attachment points 34 may be 30 to 180 degrees apart from each other around tube 12, and may be spaced between 1% and 30% of the length of compression member 12 from the end of compression member 12. As rigid compression members 12 have varying exterior diameters, as discussed above, end caps 30 may be adapted such that they can provide a snug fit on these various exterior diameters, or end caps 30 may be provided with individual interior diameters that are substantially the same as the exterior diameter of the respective rigid compression member 12. End caps 30 may be designed to transfer tension on structure 10 to the ends of compression members 12, while preventing damage to the flexible structure from the ends of compression members 12. End caps 30 may also provide a transition between the ends of compression members 12 connected to base 22 and the ground surface, providing a flat surface against the ground that is stable and reduces localized stress on the end of compression member 12. End caps 30 may have access holes 36 to allow for removal of debris that may accumulate inside end cap 30 when used on a ground surface.

Figure 14A:
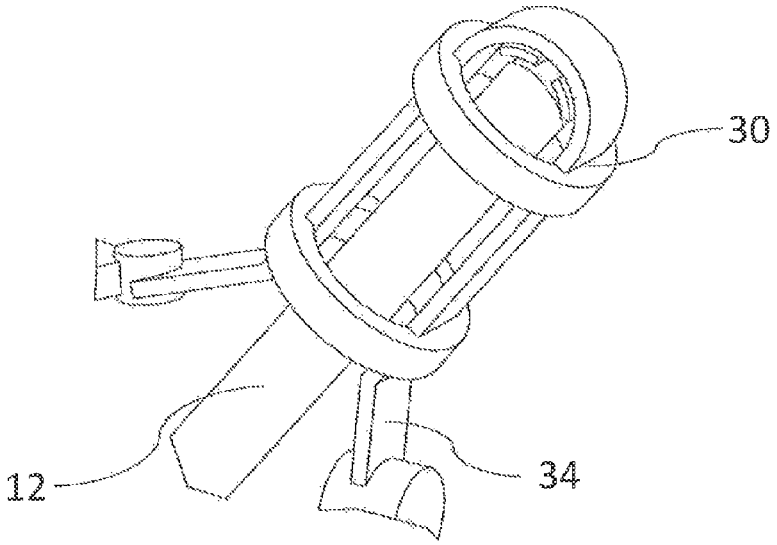
FIG. 14*a* is a detail view of an alternate embodiment of an upper end cap for a compression member.

Referring to the version of end cap 30 seen in FIG. 3*b*, end cap 30 is provided with a groove 38 that allows base 26 and seat webs 20 to wrap around the end of compression member 12. End cap 30 may, for example, be formed from flexible fabric or polymer on the inner portion to protect the web from abrasion caused by compression member 12. It may also have a metal or rigid polymer outer portion to ensure the curvature of the tensile web around the end of compression member 12 will not compromise the strength of the web. End cap 30 may be constructed from a material that provides sufficient internal friction against compression member 12 to retain compression member 12 during assembly of seating device 10. End cap 30 may also have attachment points 34 for flexible side tension members 14 shaped to direct the tension toward the end of compression member 12 instead of the connection between tension members 14 and end cap 30. As shown in FIG. 4, end cap 30 may also have a fabric or polymer protective outer sheath 32, which may be used to protect the structure from wear. Outer sheath 32 may have an added gripping surface 56 when applied to the base end caps 30 that provides increased stability to chair 10. Referring now to the version of end cap 30 seen in FIG. 5*b*, end cap 30 may also be formed from wire 40 and wire crimps 42. Referring to FIG. 6, this version of end cap 30 may have an outer cover 32 as shown, and referring to FIG. 7, it may have a metal or polymer cup 32 as shown for retaining the end of compression member 12. A third example of an end cap 30 is shown in FIG. 8, and uses wire in combination with a metal or polymer cup to form end cap 30 with a cover 32. Referring to FIG. 14*a*, the end may also have fabric or polymer rings, which may be used to direct the tension from an intermediate section along the length of compression member 12 to the end of compression member 12.

Figure 14B:
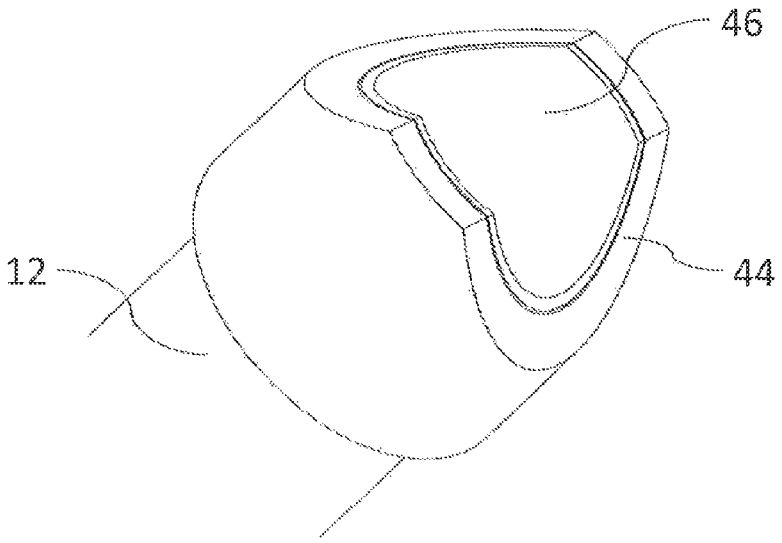
FIG. 14*b* is a perspective view of the contour on the end of the alternate embodiment of an upper end cap as shown in FIG. 14*a*.

Referring to FIG. 13*a* through FIG. 14*b*, compression members 12 may have an end profile that is curved or faceted in order to maintain maximum curvature of the tensile web around the end of each compression member 12. End profile 44 of compression member 12 may also serve to reduce sharp edges encountered by a user, and to facilitate adequate contact area between compression member 12 and a ground surface. Referring to FIG. 13*b*, the end of compression member 12 may have a rounded end profile 44 with an opening 46 to facilitate removal of debris from compression member 12. It will be understood that opening 46 may also be sized to receive other compression members 12. Referring to FIG. 14*b*, end profile 44 may also be faceted or contoured in different shapes or with different curvatures as will be understood by those skilled in the art. As shown, end profile 44 is faceted. The faceting of end profile 44 may either use straight segments, or may have a degree of curvature. The end profile 44 of compression member 12 shown in FIG. 14*b* may also have an opening 46 to facilitate removal of debris. As shown, this opening 46 may be sized to receive other compression members 12.

Seating device 10, when disassembled, may be reassembled as, or used to form, a second structure 48. For example, as shown in FIG. 9*a*, compression members 12 may be used to form a cane by nesting the group of compression members 12 one within another to form a single nested structure. In order to facilitate easier use of the cane, one or more of the compression members 12 may also have a handle 50 at a first end. A closure 58 that maintains rigid compression members 12 in the nested structure may also be provided, as shown in FIG. 9*b* and FIG. 9*c*. This closure 58 may, for example, be metal or polymer inserts. Closure 58 may also protect the ends of compression members 12 from damage, and may have holes that allow for removal of debris from the tube interior. Second structure 48 may take other forms, as will be understood by one skilled in the art, for example, a walking stick. Rigid compression members 12 may also be nested to form two structures 48 to create, for example, a pair of hiking poles. It will be understood that rigid compression members 12 may also be used to form other structures.

Figure 11:
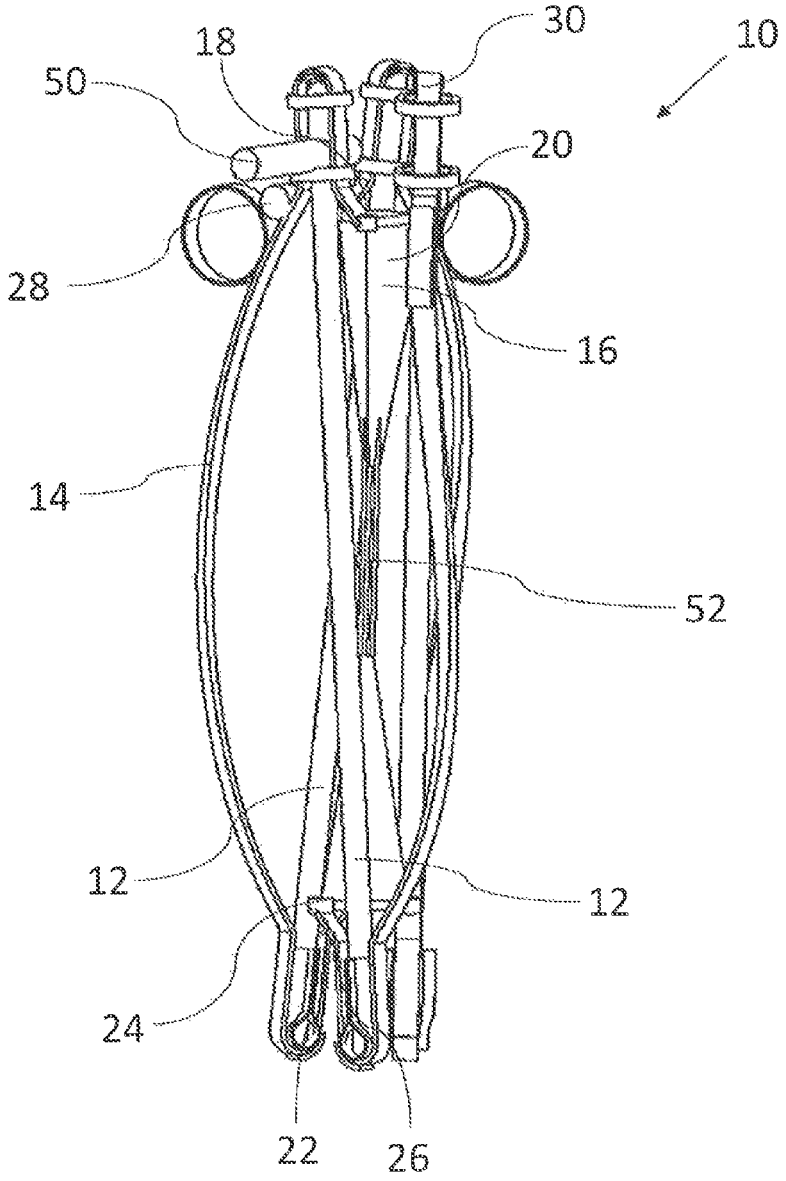
FIG. 11 is a perspective view of a partially disassembled seating device as shown in FIG. 10.

Referring to FIG. 10, seating device 10 may also have spring members 52 connected between flexible base tension members 26 and flexible supporting web 20 of seat 16. As shown in FIG. 11, these spring members 52 pull base 22 and seat 16 towards each other when tension on flexible side tension members 14 is released, allowing for easier partial collapse of seating device 10. These spring members 52 may be mounted to the mid points of seat 16 and base 22 to facilitate uniform collapse. Spring members 52 may be formed from an elastic material.

Operation

Referring to FIG. 12, in which chair 10 is disassembled, chair 10 may be assembled as shown in FIG. 10 by attaching flexible side tension members 14 between a combination of a selected base connection point 24 and a selected seat connection point 18. It will be understood that flexible side tension members 14 may be either temporarily or permanently attached to base 22 and seat 16. For example, there may be a latch or ratchet 28 flexible side tension member 14 that allows flexible side tension member 14 to be disconnected and reconnected when disassembling and reassembling chair 10. Alternatively, flexible side tension members 14 may be permanently attached to base 22 and seat 16. The group of rigid compression members 12 is inserted into base connection points 24 and each compression member 12 is angled to extend above at least a portion of base 22. The other side of rigid compression members 12 are then inserted into seat connection points 18. In order to aid with assembly, seating device 10 may have flexible sleeves 54 (shown in FIG. 1) through which rigid compression members 12 may be inserted. These flexible sleeves 54 may be constructed from an elastic material or a non-elastic material with attached elastic and material slack to aid with collapse and storage of the tension structure when compression members 12 are removed. Flexible sleeves 54 may be directly connected to one or both of the end caps 30, may have openings for insertion of compression members 12, and may also be removably connected to end caps 30 to allow insertion of compression members 12. When seating device 10 is provided with end caps 30, as described above, rigid compression members 12 may be inserted into end caps 30, and flexible side tension members 14 may be attached to an exterior portion of end cap 30. For ease of assembly, end caps 30, as well as sleeves 54, may be labelled, coloured, or both, to correspond with a particular rigid compression member 12.

Once rigid compression member 12 has been inserted, rigid compression member 12 is then removably engaged between a combination of a selected seat connection point 18 and a selected base connection point 24. The combination of connection points 18 and 24 engaged by each flexible side tension member 14 is different than the combination of connection points 18 and 24 engaged by each rigid compression member 12, as discussed above. Once all of the compression members 12 are installed, tension may be increased on one or more of the flexible side tension members 14, such as by using a latch or ratchet 28, as shown in FIG. 10.

When seating device 10 is no longer needed and is to be stored, or it is desired to carry seating device 10 to another location, seating device 10 can be disassembled. One or more of flexible side tension members 14, seat attachment points 18, or base attachment points 24, must be disengaged to allow for removal of rigid compression members 12 from seat connection points 18 and base connection points 24. For example, there may be an elasticated portion, such as in a segment of a side tension member 14 or near the connection point of base 22 or seat 16 to end cap 30 that allows for the removal of one of the end caps 30 to release the tension in structure 10. Alternatively, tension in one or more of the flexible side tension members 14 may be released, such as by using a latch or a ratchet 23. Once the tension on end caps 30 is released, rigid compression members 12 may be removed from the tensile structure. Base 22, seat 16, and flexible side tension members 14 may then be folded for storage or transport, as shown in FIG. 12. Referring to FIG. 10, the structure may have spring members 52 that manage the collapse of seat 16 and base 22 toward each other. As shown in FIG. 9, the removed compression members 12 may be inserted one within another after being removed from end caps 30, with each compression member 12 having a smaller outer diameter being successively inserted into compression members 12 having larger outer diameters to form a nested structure that can be used to form a second structure 48. As shown in FIG. 10, the largest of the compression members 12 may have a handle 50 for a walking stick or cane attached. Once compression members 12 are nested together, a closure 58 may be applied to the bottom, the top, or both, to maintain rigid compression members 12 in the nested structure. Alternatively, when seating device 10 is not in use, but it is not desired to remove compression members 12 from the tensile structure, seating device 10 may be collapsed into an intermediate structure, as shown in FIG. 11. In this case, tension is released in all of the side tension members 14, and spring members 52 draw seat 16 and base 22 together, aiding with the collapse into a single reduced structure as shown. Rigid compression members 12, which are still engaged within the tensile structure, may then be held together, for example, with straps, latches, clips, or magnets (not shown), to form a small bundle for transport.

The following describes an example of a tensegrity structure used for a seating device as described above, along with some possible advantages and features of the example:

- Chair comprised of primarily a high strength fabric tension structure and 3 to 4 compression members. There are two stages of disassembly which allow for easy transportation of the structure. The first stage allows for the controlled collapse of the tensile structure surrounded by the compression members. The compression members can then be adjoined with straps, latches, clips, magnets, etc. to form a small bundle for transportation. The second stage allows for the complete removal of the compression members from the fabric tension structure. The compression members have different inner and outer sizes such that at least one of the compression members can nest within another compression member. This ability to separate the tensile fabric structure from the compression members allows the fabric structure to fold and store within a small backpack or purse while the nested compression members can serve another purpose such as a cane, a walking stick, or two hiking poles. The fabric structure incorporates sleeves that are designed to accommodate easy assembly of the compression members within the primarily tensile fabric structure.
- Compression/Tension structure to serve the purpose of a chair or stool that is comprised of 3 or 4 compression members/tubes of different sizes that when removed from the structure can be nested one within the other with the largest tube forming the outside of the nested structure. This resultant nested structure could form a walking aid. The remaining tensile members comprised of primarily fabric and web material can be easily folded and placed in a small backpack or purse.
  - Tension portion primarily comprised of high strength/low weight polymer, high strength steel alloy cables, or organic fabric materials such as Nylon, Polypropylene, Kevlar, UHMWPE, Hemp, etc.
  - Tension portion of the above comprised of end caps of different sizes to accommodate the different sizes of compression members.
    - End caps placed primarily on the end and outside of the compression member that allow attachment of the tension portion ends along the length of the compression member.
    - One end cap attachment point can accommodate greater than 1 tension members.
    - Attachment of the tension portion ends are 30 to 180 degrees apart from one another around the tube.
    - The location where either of the attachment locations emanating from the end cap can substantially deviate along the length of the end cap. Location of the attachment points on the end cap are 1% to 30% of the compression member length from the compression member ends.
    - The end cap attachments will be connected to the tensile members of the structure and place the compression members primarily into compression.
    - End caps are labeled, or color coded, or both to ensure the proper location of the matching compression members within the tension portion of the tension/compression structure.
    - Interior of end caps will approximately match profile of tube insert ends.
    - End caps having attachment end comprised of a continuous tensile web that is directed around the end of the compression member/tube structure and thus directing the majority of the tension to the end of the compression member.
    - End caps with access holes to allow removal of debris from inside the end cap.

End caps comprised of a fabric, molded plastic, metal, etc. inner and outer structure to sandwich/protect the end cap web and direct it around the end of the compression members while ensuring that the end cap web material is not subject to its minimum recommended bend radius.

End caps with appropriate internal friction to ensure that the compression members remain attached to the end caps during the assembly of the structure.

Sleeves that ensure the proper installation of the compression members between the appropriate end caps.

End caps placed at either end of the sleeves. At one end an appropriate opening between the sleeve and the end cap is provided to allow the insertion of the compression member into the tension portion of the structure.

Sleeves can be continuous or have discontinuous openings along the sleeve length that are less than the cross sectional size of the compression member so that the compression member is guided without its end snagging on the sleeve.

Sleeve material can be compressed with an elastic material or contain an elastic material and material slack. The non-stretched length of the sleeve will be less than the length of the compression member.

Sleeve can be joined with one another with a web material but the compression members do not contact one another when the structure is assembled. This tension and semi-compression construction eliminates the need for compression member reinforcement in this region of the structure.

Sleeves may be color coded, labeled, or both, to aid in chair assembly.

3 or 4 lower to upper tensile member webs that are comprised of a latch and slack or a spring loaded web ratchet device. These devices are to ensure that the appropriate amount of tension is applied to the structure to maintain its integrity when subjected to external loads.

3 or 4 lower and upper spring members comprised of an appropriate elastic material to the facilitate the controlled collapse of the upper and lower tensile structures, Spring members anchored at locations on the horizontal tensile members approximately equidistant between anchor points of the horizontal tensile members.

Fabric tension structure to allow for cane handle that is mounted to outermost compression member to remain.

One fabric band, strap, or magnetic assembly attached to an upper and lower end cap(s) to contain the tensile and compression members once the latches/ratchets of the lower to upper tensile members have been released.

Although not limited to continuous cross sections, compression members may be comprised of tubes with a continuous cross section along the tube length and having molded/machined inserts to protect the tube end from damage.

Compression members that are labeled or color coded or both to ensure the proper location within the tension portion of the tension/compression structure.

Upper insert openings that serve to guide the tubes into a concentric nested structure once the tubes are removed from the tension/compression structure.

A hole in the bottom insert of the compression member to facilitate removing debris from the interior of the tubes.

Inserts of smallest (innermost) tube can be without holes.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A seating device comprising:

a group of three or more support members having successively smaller outer diameters, wherein each support member that has a larger outer diameter relative to at least one other support member is hollow and has an inner diameter sized to receive the outer diameter of the at least one other support member such that the support members are sized to form a nested structure;

a seat having three or more seat connection points spaced about a supporting web;

a base having three or more base connection points, and the three or more base connection points being connected by base tension members;

each support member being removably engaged between a combination of a selected seat connection point and a selected base connection point and being sufficiently rigid to support the seat above the base under load; and three or more side tension members, each side tension member being engaged between a combination of a selected seat connection point and a selected base connection point, the combination of connection points engaged by each side tension member being different than the combination of connection points engaged by each support member such that the support members support the seat above the base while the side tension members apply tension between the seat and the base to maintain a position of the seat relative to the base.

2. The seating device of claim 1, wherein the seating device comprises either three support members or four rigid compression support members.

3. The seating device of claim 1, wherein one or more side tension members are releasable to release tension in the side tension members.

4. The seating device of claim 1, further comprising end caps engaging each of the first and second ends of the three or more support members, and each end cap further engaging the seat or the base portion.

5. The seating device of claim 4, wherein the end caps comprise attachment points for attaching to at least one of the three or more side tension members.

6. The seating device of claim 1, wherein the base comprises a base web and the base tension members are components of the base web.

7. The seating device of claim 1, wherein the seating device comprises sleeves containing the support members, and the sleeves extending at least a portion of a distance between the base and the seat.

8. The seating device of claim 7, wherein each of the sleeves comprise a visible indicator of the corresponding support member.

9. The seating device of claim 1, wherein at least one end of each of the support members has an end profile that is curved or faceted.

10. A method of assembling a chair, the method comprising:

providing a base having three or more base connection points, the three or more base connection points being connected by base tension members, and a seat having three or more seat connection points spaced about a supporting web;

attaching a plurality of side tension members between a combination of a selected base connection point and a selected seat connection point;

inserting a group of three or more support members into the base connection points, the group of three or more support members having successively smaller outer diameters, wherein each support member, that has a larger outer diameter relative to at least one other support member, is hollow and has an inner diameter sized to receive the outer diameter of the at least one other support member such that the support members are sized to form a nested structure;

angling each of the support members to extend above at least a portion of the base; and inserting each of the support members into the seat connection points such that each support member is removably engaged between a combination of a selected seat connection point and a selected base connection point, the combination of connection points engaged by each side tension member being different than the combination of connection points engaged by each support member.

11. The method of claim 10, wherein the group of three or more rigid-compression support members comprises either three support members or four support members.

12. The method of claim 10, further comprising the step of increasing tension on at least one of the side tension members using a ratchet or a latch.

13. The method of claim 10, wherein the base comprises a base web and the base tension members are components of the base web.

14. The method of claim 10, wherein each of the support members further comprise end caps engaging each of the first and second ends of the three or more support members, each end cap further engaging the seat or the base portion.

15. The method of claim 14, wherein the end caps comprise attachment points for attaching to at least one of the plurality of flexible side tension members.

16. The method of claim 14, further comprising the steps of disassembling the chair comprising:

disengaging each of the first and second ends of the three or more support members from the end caps;

removing each of the support members from the seat connection points and the base connection points; and inserting support members having smaller outer diameters into support members having larger outer diameters to form the nested structure.

17. The method of claim 16, further comprising the step of releasing tension in one or more side tension members prior to removing the support members.

18. The method of claim 10, further comprising the steps of collapsing the chair by:

releasing tension in one or more side tension members; and collapsing the support members together.

19. The method of claim 10, wherein angling each of the support members comprises inserting each of the support members through a sleeve, and the sleeve extending at least a portion of the distance between the base and the seat.

20. The method of claim 10, wherein at least one end of each of the support members has an end profile that is curved or faceted.

* * * * *